United States Patent [19]

Dotson et al.

[11] Patent Number: 5,029,901

[45] Date of Patent: Jul. 9, 1991

[54] CONFIDENTIAL INFORMATION BEARING ARTICLE

[75] Inventors: Mark Dotson; William H. Mowry; William M. Saluke; A. Dale Lakes, all of Dayton, Ohio

[73] Assignee: The Standard Register Company, Dayton, Ohio

[21] Appl. No.: 476,571

[22] Filed: Feb. 7, 1990

[51] Int. Cl.[5] ..... B41L 1/20; B41L 1/24

[52] U.S. Cl. ..... 462/8 R; 462/18; 462/55; 462/67; /

[58] Field of Search ..... 282/8 R, 9 R, 11.5 R, 282/11.5 A, 10, 11, 22 R, 1 R, 27 R

[56] References Cited

U.S. PATENT DOCUMENTS

| | | | |
|---|---|---|---|
| 3,126,211 | 3/1964 | Heiken . | |
| 3,329,333 | 7/1967 | Ormond . | |
| 3,988,971 | 11/1976 | Steidinger . | |
| 4,081,127 | 3/1978 | Steidinger . | |
| 4,095,695 | 6/1978 | Steidinger . | |
| 4,157,759 | 6/1979 | Dicker . | |
| 4,172,605 | 10/1979 | Welsch . | |
| 4,278,199 | 7/1981 | Tanaka . | |
| 4,425,386 | 1/1984 | Chang . | |
| 4,576,399 | 3/1986 | White | 282/8 R |
| 4,742,954 | 5/1988 | Shishido . | |

*Primary Examiner*—Paul A. Bell

*Attorney, Agent, or Firm*—Killworth, Gottman, Hagan & Schaeff

[57] ABSTRACT

A confidential information bearing article comprising a cover sheet adhered to a base sheet is provided which is capable of providing hidden confidential information to a recipient. Through the use of camouflage, obscuring, and opacifying and reflectivity increasing coatings, the paper used for the mailer becomes effectively opaque, and information printed on the inside of the article is substantially unreadable from the outside. The article includes an adhesive for securing the base sheet and cover sheet and perforations along the edges to assist the recipient in opening the article.

59 Claims, 4 Drawing Sheets

CONFIDENTIAL INFORMATION BEARING ARTICLE

BACKGROUND OF THE INVENTION

This invention relates to a confidential information bearing article, and more particularly to a construction in which a base sheet and a cover sheet having an opacifying and light reflective coating on their outer surfaces and bearing confidential information on their inner surfaces are secured together so as to prevent reading of the confidential information until opened.

A variety of articles have been used to conceal secret or confidential information within a two or more ply construction and to prevent unauthorized viewing thereof. Such confidentiality has been needed for lottery tickets, promotional coupons or offers, game cards, pay checks and the like. Typically, the confidential information is sealed between two or more plies of paper, paper board, plastic or the like. The construction is designed to be pulled apart to reveal the confidential information.

Likewise, many other types of confidential information are transmitted through the mail in the form of checks, invoices, bank statements, and the like. Envelopes have been typically used for transmitting this type of confidential information. Postcards provide an inexpensive alternative to sending messages in envelopes, but in the past they have not been suitable for the delivery of confidential information because the information is not concealed.

However, attempts have been made to produce post card constructions which permit the obscuring of confidential information until receipt by the addressee. For example, Tanaka, U.S. Pat. No. 4,278,199, teaches a post card construction in which confidential information is preprinted on the card, and then an opaque cover member which is substantially smaller in size than the card is adhered to the card, covering the confidential information.

Shishido, U.S. Pat. No. 4,742,954, also teaches a post card construction in which preprinted confidential information may be hidden from view by a laminated cover sheet which is secured to a transparent protection film layer bonded to a base sheet. The cover sheet is delaminated from the base sheet by the addressee of the post card to reveal the confidential information.

However, the construction of Shishido comprises several layers, one of which must be laminated by a heating operation requiring a closely controlled temperature range. Shishido also requires at least two separate printing operations. Further, neither Shishido nor Tanaka describe a procedure for automating the production of a series of postal cards.

Ormond, U.S. Pat. No. 3,329,333 also teaches a post card or mailer device for checks or other confidential information which consists of a base sheet containing indicia, a cover sheet having a tacky adhesive around its periphery, and a removable intermediate sheet which is attached to the tacky undersurface of the cover sheet. The intermediate sheet is removed before mailing and the cover sheet is adhered to the base sheet and remains secure until the cover sheet is removed to reveal the intended message. In an alternative embodiment, the cover sheet is applied directly to the base sheet with a pressure sensitive tape for use in automated mailings.

Hicken, U.S. Pat. No. 3,126,211, relates to a mailer for checks, invoices, and other confidential information consisting of a base sheet bearing confidential indicia and addressee information and a cover sheet which is strippably secured to the base sheet to cover the confidential information.

Chang, U.S. Pat. No. 4,425,386, relates to a multisheet business form having four plies. The top ply has on its surface a spot coating which comprises chromogen-containing pressure rupturable microcapsules and a color developer material which upon impact ruptures and forms an image on the underlying plies. The second and third plies may also support the coating on all or portions of their surfaces, while the fourth ply serves as a backing sheet. This form may also be printed in a continuous form assembly.

Welsch et al, U.S. Pat. No. 4,172,605 discusses the use of a chemically reactive printer ribbon in which the ribbon is coated with a color forming chromogenic substance in solution. Selected areas on the front of a business form are coated with a color developer material so that when impacted with the ribbon, an image is formed on the paper. However, the ribbon must be in direct contact with the underlying receiving sheet to permit transfer of the color former to the color developer for proper image formation.

A problem with previous post card or envelope mailers containing confidential information has been the lack of opacity of the paper stock used. When held up to a strong light source, the confidential information could be perceived through the cover and/or base sheets of the construction. Increasing the thickness of the paper stock used results in greater opacity, but adds material costs to the mailer construction and makes the mailer more difficult to process as a continuous form. Further, the added thickness and weight of the mailer may increase postal costs.

Other commercially-available mailers incorporate a random ink pattern on the inner surfaces of the top and bottom sheets which attempt to prevent the contents of the mailer from being readable through the mailer. See also U.S. Pat. Nos. 3,988,971, 4,081,127, and 4,095,695 which are hereby incorporated by reference. Other mailers employ a random block out pattern on the inner surfaces of the mailer having specific areas which have been coated with carbon ink. These carbon patches correspond with areas on the outer surface of the cover sheet which have been printed with block out patterns so that confidential information may be printed on the outside of the mailer and be transferred to an insert sheet inside of the mailer without being read from the outside. This mailer also includes a tab portion which is releasably secured to one ply of the mailer for opening. See U.S. Pat. No. 4,157,759. However, all of these mailers require the insertion of a separate sheet containing the intended message.

In addition to the limitations of the prior art, the use of sophisticated processing equipment by the U.S. Postal Service has resulted in new restrictions on the types of paper that may be used for mailers. For example, envelopes or mailers made from coated paper or plastic cannot be properly processed when using automated equipment. Also, paper containing dark fibers or which has block out patterns printed on the interior and/or exterior surfaces thereof may interfere with the operation of the optical character readers (OCRs) and bar code sorters used by the Postal Service. As a result, the Postal Service has requested that the address-bearing surface of a mailer must have a sufficient light reflective surface so that it can be read by an OCR scanner and must have a reflected light difference between the paper and the ink of at least 30%. In addition, the paper used to construct the mailers should have sufficient opacity to prevent printing, such as block out patterns, from inside the mailer from showing through in the OCR and bar code reading areas so that such printing does not interfere with OCR scanning.

Banking institutions have also implemented new regulations in regard to checks. In May, 1988, the Federal Reserve Board issued Regulation CC to implement the Expedited Funds Availability Act to facilitate the expedited processing of checks. Many checks are printed with markings on the reverse side of the check, such as carbon bands, blocks of jumbled letters and/or numbers, random or designed backgrounds, or cross-hatching applied for security in mailers to prevent reading the check information from the reverse side or through the mailer. However, when endorsing checks of this nature, depositary banks may be unable to avoid the markings, patterns, or designs, and consequently, paying banks may not be able to read the endorsement, causing the check to be returned and resulting in an unwanted delay in payment processing. Consequently, the American National Standards Institute (ANSI) which issues standard specifications for check endorsements has recommended that the check background color should be plain white, or a plain, light pastel color, and if printed patterns or designs are used as background, they should be in a muted, light color.

Accordingly, the need still exists in the art for a simple construction for concealing a wide variety of confidential information such as lottery tickets, game cards, coupons, checks, financial instruments, and other documents containing confidential information. The construction should be capable of keeping the printed information confidential until opened by the recipient or addressee and, in the case of mailer constructions, which complies with the recommended standards set by the U.S. Postal Service and banking institutions. Further, there remains a need for such a construction which can be used in an automated system for the production of a series of such confidential information bearing articles.

SUMMARY OF THE INVENTION

The present invention meets that need by providing a confidential information bearing article such as a mailer construction for checks and other confidential documents comprising a cover sheet adhered to a base sheet which may be easily printed by automated systems and insures confidentiality until receipt by the addressee through the use of information obscuring coatings applied to the outer and/or inner surfaces of the cover and base sheets. An adhesive, applied to the edges of the article, enables the recipient to readily peel back the cover sheet and read the confidential information.

In accordance with one aspect of the present invention, a construction information bearing article is provided which comprises a base sheet, a cover sheet overlying the base sheet and an adhesive securing the cover sheet and base sheet such that the cover sheet and base sheet are readily separable. By "readily separable" we mean an adhesive which will maintain the integrity of the construction during normal handling but which will permit separation of the plies and access to the interior of the construction by the application of force by the end user. However, it is desired that the adhesive be of sufficient strength to leave evidence of the fact that a user has gained access to the interior of the construction. The cover sheet and base sheet may contain printed information on one or more of their respective inner surfaces.

To help insure that the information printed on the base sheet and cover sheet remains hidden from view, the material comprising the base sheet and cover sheet should have a high level of opacity combined with images confusing to the eye, thus rendering the printed matter inside substantially unreadable through the mailer construction. To achieve this, the respective outer surfaces of the base sheet and cover sheet are printed with a camouflaging block out pattern. In a preferred embodiment, the camouflage pattern comprises a random printed pattern of jumbled numbers and jumbled letters printed with a camouflage ink. The camouflage pattern is first overcoated with an obscuring coating of a colored ink, and then overcoated with means for increasing the opacity and reflectivity of respective outer surfaces of the base and cover sheets such as an opacifying and reflectivity increasing coating. This results in a light reflective surface on the outside of the mailer which helps prevent printed matter on the inside from being read. Optionally, the same series of steps may be performed on the inner surface of the construction.

The confidential information bearing article includes an adhesive which, in one embodiment of the invention, is applied around the peripheral edges of the cover sheet and base sheet. The cover sheet and base sheet also may have perforated removable edge portions for easy separation.

In a preferred form, the article comprises a mailer construction in which the cover sheet includes a die cut window area which corresponds to the portion of the base sheet in which addressee information is to be printed. The window area of the cover sheet is preferably covered with a transparent material such as glassine on its inner surface to provide protection to the addressee information.

In another embodiment of the invention, a confidential information bearing article is provided which comprises a single sheet having a first half portion and a second half portion, wherein the first half portion may be folded over onto the second half portion to form a folded sheet. The inner surface of the sheet may be printed with indicia. The surfaces of the sheet which will form the outer surfaces of the mailer construction are printed with the camouflaging block out pattern and coated with obscuring and opacifying and reflectivity increasing coatings as described above. The article includes an adhesive which may be applied around the peripheral edges of the first half portion and second half portion of the sheet, and may include perforated removable edge portions. In a preferred form, the invention comprises a mailer construction which also may include a die cut window covered with a transparent material such as glassine on the first half portion of the sheet.

In another embodiment of the invention, a confidential information bearing article is provided which comprises a single sheet continuous form having a left half portion and a right half portion. The front surface of the continuous form, which forms the inner surfaces of the article may be printed with indicia with the use of automated equipment. The back surface of the continuous form, which forms the outer surface of the article, is printed with the camouflaging block out pattern and coated with the obscuring coating, then overcoated with the opacifying and reflectivity increasing coatings as described above. After the form has been printed and coated, the left half portion of the form may be folded onto the right half portion of the form to form a continuous folded sheet. The article also includes transverse perforations for separating the form into individual articles and an adhesive which may be applied around those areas which form the peripheral edges of the individual articles, and may also include perforated removable edge portions for easy separation. In a preferred form, the article comprises a continuous mailer form which also includes die cut windows covered with a transparent material such as glassine or the like at predetermined intervals along the left half portion of the form.

In yet another embodiment of the invention, a confidential information bearing article is provided which comprises a base sheet, a cover sheet overlying the base sheet, and an indicia-bearing sheet positioned between the base and cover sheets. The respective inner surfaces of the cover and base sheets may be printed with indicia as well. The respective outer surfaces of the article are printed with the camouflaging block out pattern and coated with the obscuring and opacifying and reflectivity increasing coatings as described previously. Again, the cover and base sheets are preferably secured at their peripheral edges with an adhesive and have perforated removable edge portions. In a preferred form, the article comprises a mailer which may also include a die cut window on the cover sheet which is covered with a transparent material such as glassine.

In a further embodiment of the invention, a confidential information bearing article is provided which comprises a base sheet and a cover sheet overlying the base sheet. The respective inner surfaces of the base sheet and cover sheet are printed with the camouflage block out pattern and coated with the obscuring and opacifying and reflectivity increasing coatings as described above. The inner surfaces of the base sheet and cover sheet are then overprinted with indicia. Thus, the reflective coating is on the inside of the article and the outside of the article has a clean, uncoated surface. The cover and base sheets are preferably secured at their peripheral edges with an adhesive as described above and include perforated removable edge portions. In a preferred form, the article is a mailer which also preferably includes a die cut window on the cover sheet covered with a transparent material such as glassine or the like.

Accordingly, it is an object of the present invention to provide a confidential information bearing article including a base sheet and a cover sheet bearing confidential information secured within which is simPle to manufacture and print by automated systems and which is capable of providing hidden confidential information to a recipient. Other objects and advantages of the invention will be apparent from the following description, the accompanying drawings and the appended claims.

DETAILED DESCRIPTION OF THE PREFERRED EMBODIMENT

For ease of understanding, the confidential information bearing article of the present invention will be described with reference to a preferred mailer construction. However, it will be apparent to those skilled in the art that the invention is applicable to a variety of articles such as lottery tickets, coupons, promotional game cards, pay checks, and the like where there is a need to maintain information confidential until an article is opened by the recipient.

Figure 1:
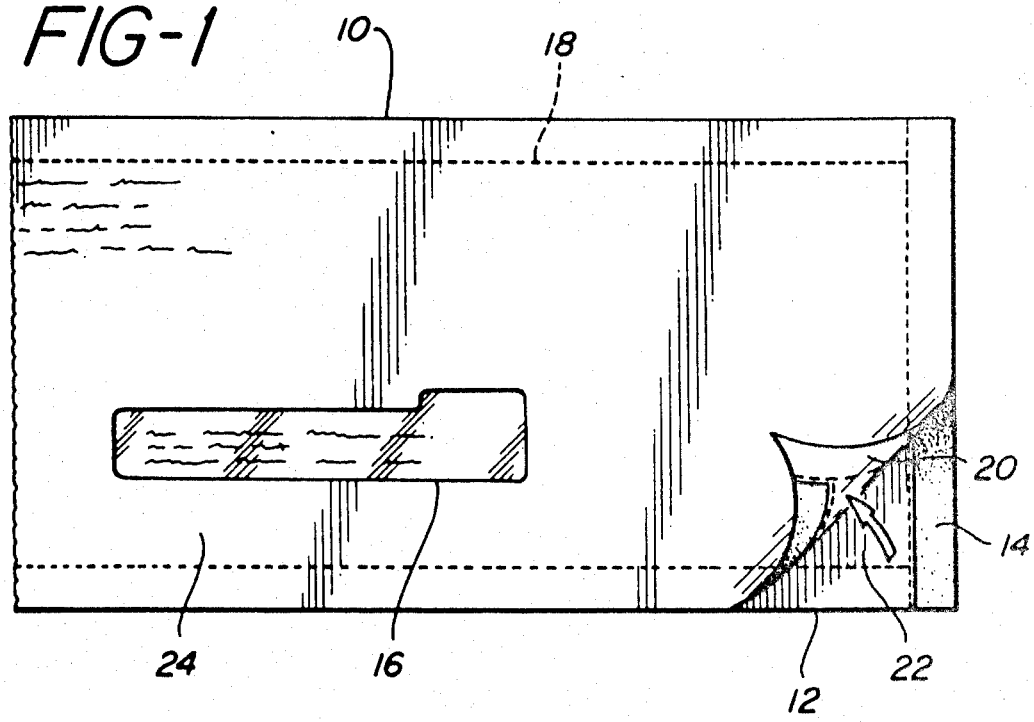
FIG. 1 is a front plan view of a mailer construction showing the cover sheet partially peeled back in accordance with the present invention.

The preferred mailer construction of the present invention is illustrated in FIG. 1 and includes a cover sheet 10 and a base sheet 12. The mailer is preferably constructed of a cellulosic material, preferably a 24# bond paper, although other weights of paper or paper-like materials are also within the scope of the invention. An adhesive 14 is applied to the peripheral edges of the mailer to seal its contents but enable the recipient to readily peel back the cover sheet and read the information contained therein. The adhesive is preferably a hot-melt glue, although other known adhesives such as pressure sensitive adhesives may be used. In other constructions of the confidential information bearing article of the present invention, it may be useful to apply an adhesive, such as a fugitive adhesive, over substantially the entire surface of the base and/or cover sheets.

An optional die cut window 16 is positioned over the area where the name and address information of the recipient is to be printed on the inner surface 22 of the mailer. The window is covered with a transparent material such as glassine or the like which is secured around the edges of the window to give further protection to the addressee information. Perforations 19 are also positioned inside of the peripheral sealed edges of the mailer and can be removed by the recipient to assist in opening the mailer.

Figure 2:
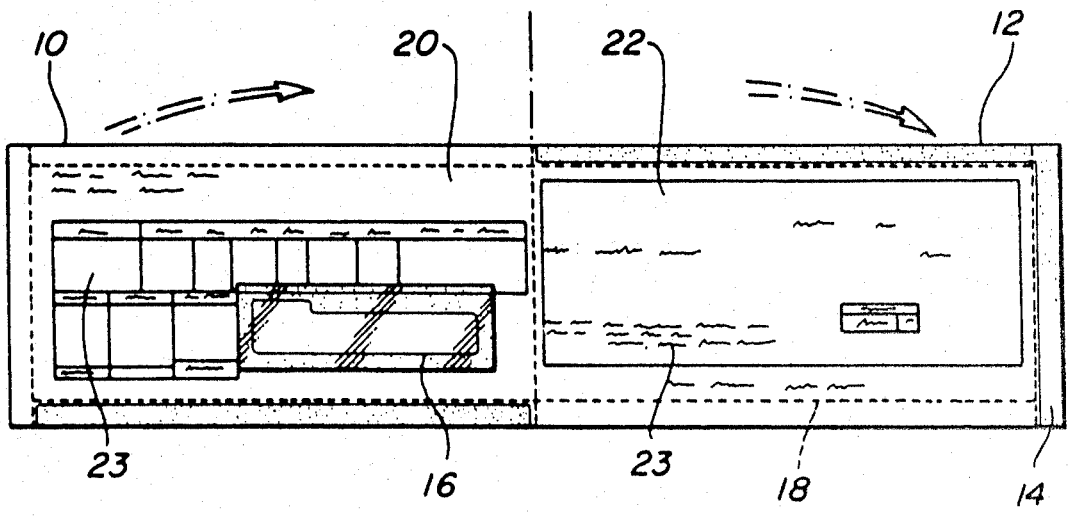
FIG. 2 is a front plan view of a mailer construction in a fold-out position prior to assembly in accordance with the present invention.

As illustrated in FIG. 2, the inner surface 20 of cover sheet 10 and the inner surface 22 of base sheet 12 may contain confidential printed information 23 such as a combined payroll check and stub. To ensure the confidentiality of the printed information inside the mailer, the respective outer surfaces of the base sheet and cover sheet are printed with a camouflage image and then coated with obscuring and opacifying coatings. These three means work together to prevent the printed material inside from being read, while at the same time presenting an outer surface of good reflectivity.

Figure 5:
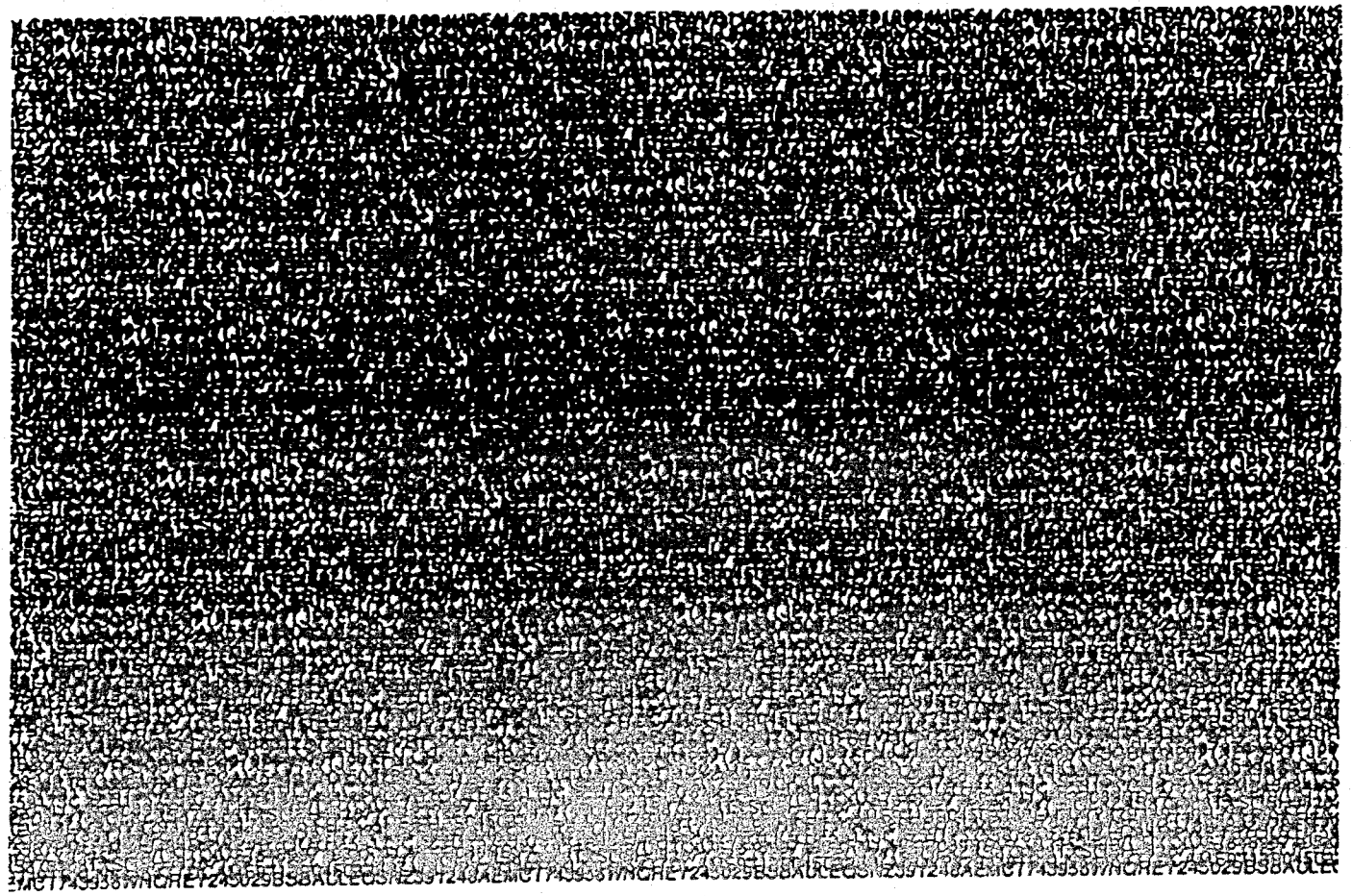
FIG. 5 illustrates a preferred camouflage block out pattern of the present invention.
Figure 6:
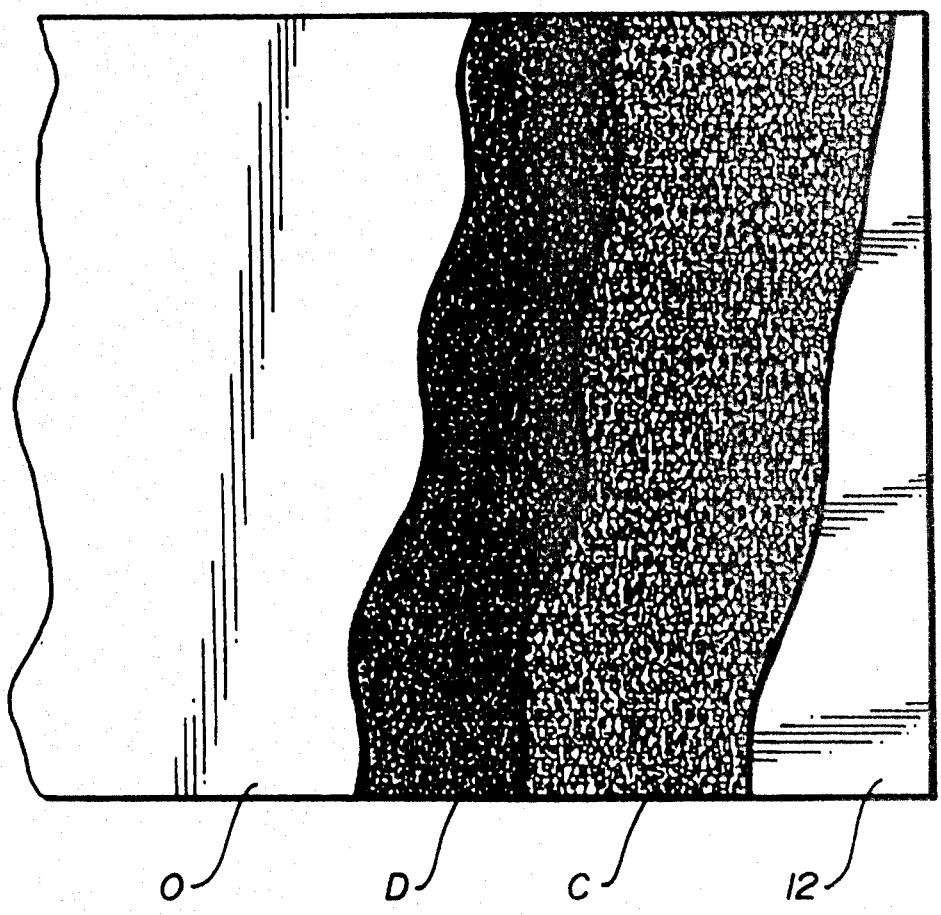
FIG. 6 is a plan view of a mailer construction of the present invention with the information obscuring and opacifying coatings partially broken away.

Referring now to FIGS. 5-6, the information obscuring coating process of the present invention is illustrated. The first step in the process involves printing the respective outer surfaces of the cover sheet and base sheet with a camouflage pattern, C, as illustrated in FIG. 5. A preferred camouflage pattern is a block out pattern which includes a random printed pattern of jumbled letters and jumbled numbers in which the lines of type are overlapping. Preferably, the type fonts and sizes approximate the type fonts and sizes which are used to print the confidential information contained on the interior faces of the mailer. However, other camouflage patterns may be used to good effect.

The camouflage pattern is preferably printed using a dark gray, rather than black, ink. In this manner, the color, pattern, and density of the camouflage pattern as perceived by the eye will closely match the color, pattern, and density of the confidential information printed within the mailer when viewed by transmitted light. The difference is that the confidential information is printed on the inner faces of the sealed mailer while the camouflage pattern is printed on the outer faces of the mailer. Additionally, where the confidential information is printed in a color other than black or dark gray, it may be desirable to use a similar color to print the camouflage pattern. For example, if the confidential information is printed using a blue ink, the camouflage pattern may also be printed in blue.

Next, the camouflage pattern is overcoated with an obscuring coating D, such as a gray ink. The gray ink may also contain pigments. However, it is preferred to use dye-based inks. Although aqueous-based inks are preferred, any ink suitable for printing by flexography, gravure, letterpress, wet offset, or dry offset may be used.

One preferred ink comprises about 5% by weight hydroxyethylated polyethylene imine, available from Morton Thiokol; about 8% by weight sulfonated nigrosine; about 5% to 15% by weight isopropyl alcohol; about 0.5% by weight of a defoamer such as SWS 213 Defoamer, available from Air Products; and 71% to 85% water by weight. In an alternative formulation, the gray ink may comprise about 40% by weight polyethylene glycol 400, available from Union Carbide; about 5% by weight of a 50% gluconic acid solution; 6% by weight tetrahydrofurfuryl alcohol; about 2% by weight Solvent Black 7; about 5% to 10% by weight isopropyl alcohol; about 0.5% by weight defoamer; and 35% to 45% water by weight. In another alternative formulation, the gray ink may comprise about 15% by weight methoxypolyethylene glycol 350, available from Union Carbide; about 5% by weight of a 50% gluconic acid solution; about 6% by weight tetrahydrofurfuryl alcohol; about 2% by weight Solvent Black 7; about 5% to 10% by weight isopropyl alcohol; about 0.5% by weight defoamer; and about 60% to 70% water by weight.

As discussed above, in certain situations it may be desirable to print the camouflage image in a color of ink other than gray. Exemplary colored ink compositions for use in the practice of the present invention include a blue ink comprising about 5% Reactive Blue 72 dye, about 5% to 15% isopropyl alcohol, and the remainder water, all percentages by weight. An exemplary red ink comprises about 5% Reactive Red 24 dye, about 5% to 15% isopropyl alcohol, and the balance water. An exemplary yellow ink comprises about 4% Direct Yellow 166 dye, about 10% isopropyl alcohol, and the remainder water.

The exact formulation of the ink making up the obscuring coating is not critical. However, it should function to reduce the contrast between the dark jumbled characters of the camouflage pattern and the remainder of the outer surface of the sheet. By reducing the print contrast ratio between pattern and unprinted surface, the camouflage pattern becomes nearly impossible to read by the eye when the light reflective opacifying overcoat has been applied. Accordingly, automated postal sorting equipment including OCR scanners are not able to "read" the camouflage pattern and the pattern does not interfere with the automated reading of addressee information.

In the final coating step, the obscuring coating is overcoated with an opacifying reflectivity increasing coating, O, such as a white reflective ink. Such an ink is CR 37861 Aqueous High Reflective White, available from BASF, Inmont Division. As illustrated in FIG. 7, the opacifying and reflectivity increasing coating provides a light reflective surface to the mailer. This permits ready scanning of addressee information by automated sorting equipment as well as providing a light-colored, neutral background for receiving endorsement information on the back of the check portion of the mailer.

By "opacifying" we mean a coating which increases the opacity of the substrate to light. However, the final product need not be, and in the vast majority of cases is not, completely opaque to light. Rather, it is desired that the base sheet and cover sheet have a high level of opacity which when combined with the camouflage pattern and obscuring coating, render printed matter inside substantially unreadable through the mailer construction.

In another embodiment of the invention illustrated in FIG. 2, the preferred mailer construction may comprise a single sheet. The form includes a first half portion 10 and a second half portion 12. The inner surfaces 20 and 22 may be printed with indicia such as a combined check and stub. The outer surfaces are printed with the camouflaging block out pattern C and overcoated with the obscuring and opacifying gray and white coatings D and O, respectively. As shown in FIG. 2, the mailer construction includes an adhesive 14 applied around the peripheral edges of the mailer and includes perforated removable edge portions 18 and perforations 19. The mailer also includes a die cut window 16 covered with glassine or other transparent material on the first half portion 20.

Figure 3:
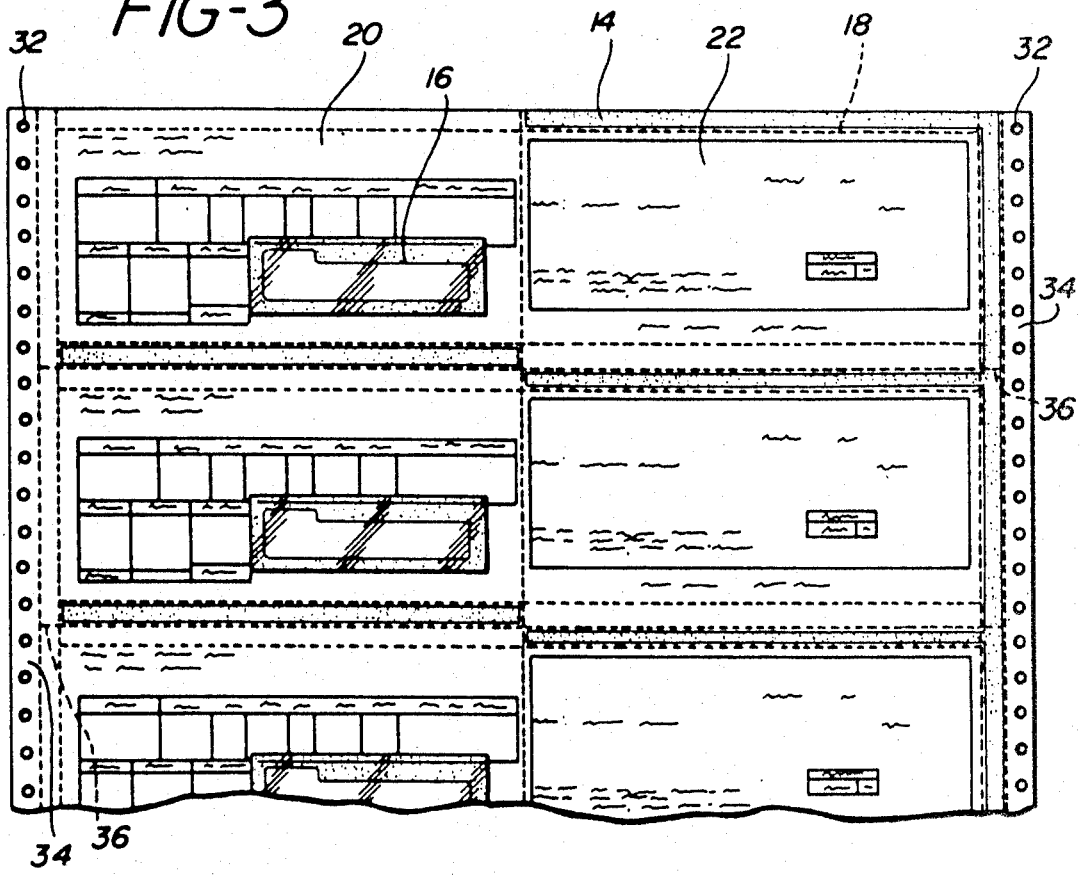
FIG. 3 is a fragmentary plan view of a continuous form mailer construction of the present invention.

In another embodiment of the invention illustrated in FIG. 3, a preferred mailer construction is provided which comprises a single sheet continuous form which may be used in an automated printing device. The single sheet comprises left half portion 20 and right half portion 22 which may be folded over to form a single sheet. As will be apparent to one of ordinary skill in the art, the printing on the left half portion and right half portion of the continuous form may be interchanged. The front surface of the single sheet may be printed with indicia such as a combined check and stub. The back surfaces of the sheet are printed with the camouflaging block out pattern and coated as described previously. As shown in FIG. 3, the mailer construction includes an adhesive 14 applied around the peripheral edges of the sheet, and includes perforated removable edge portions 18 and perforations 19. The mailer also includes a die cut window 16 covered with a transparent material such as glassine on the left half portion of the sheet. For automated printing, the form includes pin feed holes 32 in detachable margins 34 extending along both sides thereof. The form also includes transverse perforations 36 for separating the continuous form into individual mailers.

Figure 4:
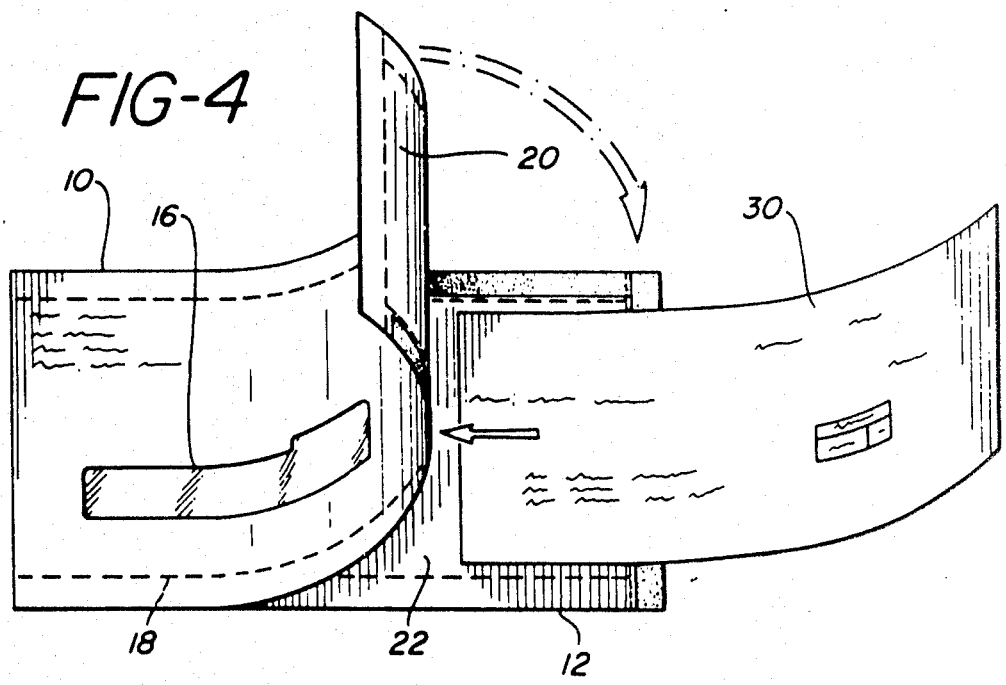
FIG. 4 is a perspective view of a mailer construction with a loose sheet incorporated therein in accordance with the present invention.

In another embodiment of the invention illustrated in FIG. 4, a mailer is provided which comprises a cover sheet 10 and a base sheet 12, with an indicia bearing sheet 30 positioned between the base and cover sheets. Inner surfaces 20 and 22 of the mailer may be printed with indicia as well. The outer surfaces are printed with the camouflaging block out pattern and coated as described previously. As illustrated in FIG. 4, cover sheet 10 and base sheet 12 are secured at their peripheral edges with an adhesive 14 and also include perforated removable edge portions 18 and perforations 19. The cover sheet 10 also includes a die cut window which is covered with a transparent material.

While the confidential information bearing article, and a preferred mailer construction, of the present invention has been described with camouflage, obscuring, and opacifying and reflectivity increasing coatings on the exterior surfaces thereof, the coatings may be applied to respective inner surfaces of the article so as to provide clean outer surfaces to the article. Alternatively, where there is a high need for confidentiality, the coatings may be applied to both the inner and outer surfaces of the article. For example, where the article is a lottery ticket, two-sided coating will provide a very effective article for maintaining the confidentiality of information. In either embodiment, inner surfaces of the article may then be overprinted with indicia, including confidential information, checks, or other financial instruments. The information obscuring coating provides a neutral background for printing while also preventing that information from being viewed by holding the mailer up to a source of light.

A summary of a preferred automated process for constructing a preferred mailer construction in accordance of the present invention is described below.

A roll of continuous form paper is printed on its back side with a camouflaging block out pattern such as the one illustrated in FIG. 5 by conventional printing means such as flexographic or gravure printing. The paper is then overcoated with a first obscuring coating of an ink of a color which aids in hiding the information, also by conventional printing means. The obscuring coating is then overcoated with an opacifying and reflectivity increasing coating of white ink. The paper is allowed to dry and is then rewound. The resulting paper is effectively opaque. That is, while the paper is not completely opaque to light, the combination of camouflaging pattern, obscuring coating, and opacifying and reflectively increasing coatings renders printed information substantially unreadable through the paper.

The continuous paper is then fed through a printing operation where it is printed with return address information on its back side and printed with any desired interior images on its front side. The paper is then perforated around the periphery of the individual mailers outlined on the form. If desired, windows are die cut along specific intervals on the left half portion of the form and a transparent material such as glassine may optionally be applied and glued over the window area. A hot melt adhesive is then applied to selected peripheral edges of the individual mailers on the form.

The continuous form paper may then be shipped to a customer or other potential user where individual payee and amount information is printed onto the front side of the form. The paper may then be fed through a document heat sealing device such as the Series 400 Thermobond® unit available from The Standard Register Company. The machine automatically feeds in the continuous paper, folds the form in half, and heat seals the edges of the form so that it is secured. The forms may then be burst and trimmed to separate the individual mailers.

In order that the coating process of the invention may be more readily understood, reference is made to the following examples which are designed to illustrate the invention, but not limit the scope thereof.

EXAMPLE 1

A gray ink composition for use as an obscuring coating in accordance with the present invention was prepared by adding 40% by weight polyethylene glycol 400, 5% by weight of a 50% gluconic acid solution, 6% by weight tetrahydrofurfuryl alcohol, and 2% by weight Solvent Black 7 in a vessel equipped with a mechanical stirrer. The mixture was stirred for 20–30 minutes at room temperature at moderate speed. Next, 7% by weight isopropyl alcohol and 0.5% by weight SWS 213 Defoaner were added to the mixture and stirred for another 10 minutes. Water (39.5% by weight) was then slowly added while the mixing was continued. The ink mixture was then filtered through a 50 micron filter.

EXAMPLE 2

A gray ink composition for use as an obscuring coating in accordance with the present invention was prepared by adding 15% by weight methoxypolyethylene glycol 350, 5% by weight of a 50% gluconic acid solution, 6% by weight tetrahydrofurfuryl alcohol, and 2% by weight Solvent Black 7 in a vessel equipped with a mechanical stirrer. The mixture was stirred for 20–30 minutes at room temperature at moderate speed. Next, 7% by weight isopropyl alcohol and 0.5% by weight SWS 213 Defoamer were added to the mixture and stirred for another 10 minutes. Water (64.5% by weight) was then slowly added while mixing was continued. The mixture was then filtered through a 50 micron filter.

EXAMPLE 3

A gray ink composition for use as an obscuring coating in accordance with the present invention was prepared by adding 8% by weight sulfonated nigrosine, 10% by weight isopropyl alcohol, 0.5% by weight SWS 213 defoamer, and 76.5% water by weight in a vessel equipped with a mechanical stirrer. The mixture was stirred for 10 minutes at room temperature. The ink mixture was then filtered through a 50 micron filter.

EXAMPLE 4

A roll of uncoated 24# bond paper was printed with a camouflage image on one surface thereof. The printed surface of the paper was then overcoated with the obscuring gray ink composition of Example 3. While still wet, the paper was then overcoated with an opacifying coating of a light reflective white ink available from BASF, Inmont Division, under the designation CR37861 Aqueous High Reflective White. The paper was then dried and rewound.

Having described the invention in detail and by reference to preferred embodiments thereof, it will be apparent that modifications and variations are possible without departing from the scope of the invention defined in the appended claims.

What is claimed is:

1. A confidential information bearing article comprising a base sheet, a cover sheet overlying said base sheet, and an adhesive securing an inner surface of said cover sheet to an inner surface of said base sheet such that said cover sheet and base sheet are readily separable, said base sheet or said cover sheet having indicia on at least one of their respective inner surfaces, said article including means for rendering said indicia substantially unreadable through said article, said means comprising:

(1) a camouflage pattern on the respective outer surfaces of said base sheet and said cover sheet;
(2) means for obscuring said camouflage pattern; and
(3) means for increasing the opacity and reflectivity of said respective outer surfaces of said base sheet and said cover sheet.

2. The article of claim 1 wherein said camouflage pattern comprises a random printed pattern of jumbled numbers and jumbled letters.

3. The article of claim 1 wherein said means for obscuring said camouflage pattern comprises a first obscuring coating deposited on said camouflage pattern.

4. The article of claim 3 wherein said first obscuring coating comprises a water-based ink which includes a colored dye or pigment.

5. The article of claim 1 wherein said means for increasing the opacity and reflectivity of said respective outer surfaces of said base sheet and said cover sheet comprises a second opacifying and reflectivity increasing coating deposited on said first obscuring coating.

6. The article of claim 5 wherein said second opacifying and reflectivity increasing coating comprises a water-based white ink.

7. The article of claim 1 in which said cover sheet and said base sheet are secured at their peripheral edges.

8. The article of claim 1 wherein said cover sheet and said base sheet have perforated removable edge portions.

9. The article of claim 1 wherein said adhesive comprises a hot melt glue.

10. The article of claim 1 wherein said article comprises a mailer construction having a cover sheet which includes a die cut window.

11. The article of claim 10 wherein said die cut window on said cover sheet is covered with a transparent material.

12. The article of claim 11 wherein said transparent material is glassine.

13. A confidential information bearing article comprising a single sheet having a first half portion and a second half portion wherein said first half portion is adapted to be folded over onto said second half portion to form respective inner surfaces of a folded sheet, and an adhesive on at least one of said first and second half portions adapted to secure said respective half portions of said folded sheet such that said first half portion and said second half portion are readily separable, said first half portion or said second half portion having indicia on at least one inner surface of said sheet, and said article construction including means for rendering said indicia substantially unreadable through said article, said means comprising:

(1) a camouflage pattern on the outer surface of said sheet;
(2) means for obscuring said camouflage pattern; and
(3) means for increasing the opacity and reflectivity of said outer surface of said sheet.

14. The article of claim 13 wherein said camouflage pattern comprises a random printed pattern of jumbled numbers and jumbled letters.

15. The article of claim 13 wherein said means for obscuring said camouflage pattern comprises a first obscuring coating deposited on said camouflage pattern.

16. The article of claim 15 wherein said first obscuring coating comprises a water-based ink which includes a colored dye or pigment.

17. The article of claim 13 wherein said means for increasing the opacity and reflectivity of said outer surface of said sheet comprises a second opacifying and reflectivity increasing coating deposited on said first obscuring coating.

18. The article of claim 17 wherein said second opacity and reflectivity increasing coating comprises a water-based white ink.

19. The article of claim 13 in which said first half portion and said second half portion of said sheet are adapted to be secured at their peripheral edges.

20. The article of claim 13 wherein said first half portion and said second half portion of said folded sheet have perforated removable edge portions.

21. The article of claim 13 wherein said adhesive comprises a hot melt glue.

22. The article of claim 13 wherein said article comprises a mailer construction in which said first half portion of said sheet includes a die cut window.

23. The article of claim 22 wherein said die cut window on said first half portion of said folded sheet is covered with a transparent material.

24. The article of claim 23 wherein said transport material is glassine.

25. A confidential information bearing article comprising a continuous form having a left half portion and a right half portion wherein said left half portion is adapted to be folded over onto said right half portion to form respective inner surfaces of a folded sheet, and an adhesive on at least one of said left and right half portions adapted to secure said respective half portions of said sheet such that said left half portion and said right half portion are readily separable, at least one of said left half portion and said right half portion having indicia on at least one inner surface thereof, and article including means for rendering said indicia substantially unreadable through said article, said means comprising:

(1) a camouflage pattern on the surface of said continuous form opposite said inner surfaces;
(2) means for obscuring said camouflage pattern; and
(3) means for increasing the opacity and reflectivity of said respective back surface of said continuous form.

26. The article of claim 25 wherein said camouflage pattern comprises a random printed pattern of jumbled numbers and jumbled letters.

27. The article of claim 25 wherein said means for obscuring said camouflage pattern comprises a first obscuring coating deposited on said camouflage pattern.

28. The article of claim 27 wherein said first obscuring coating comprises a water-based ink which includes a colored dye or a pigment.

29. The article of claim 25 wherein said means for increasing the opacity and reflectivity of said surface of said continuous form opposite said inner surfaces comprises a second opacifying and reflectivity increasing coating deposited on said first information obscuring coating.

30. The article of claim 29 wherein said opacifying coating comprises a water-based white ink.

31. The article of claim 25 in which said left half portion and said right half portion of said continuous form are adapted to be secured at their peripheral edges.

32. The article of claim 25 wherein said left half portion and said right half portion of said continuous form have perforated removable edge portions.

33. The article of claim 25 wherein said adhesive comprises a hot melt glue.

34. The article of claim 25 wherein said article comprises a mailer construction in which said left half portion of said continuous form includes a die cut window.

35. The article of claim 34 wherein said die cut window on said left half portion of said continuous form is covered with a transparent material.

36. The article of claim 35 wherein said transparent material is glassine.

37. A confidential information bearing article comprising a base sheet, a cover sheet overlying said base sheet, an adhesive securing an inner surface of said cover sheet to an inner surface of said base sheet such that said cover sheet and base sheet are readily separable, and an indicia-bearing sheet positioned between said respective inner surfaces of said base sheet and said cover sheet, said article including means for rendering said indicia on said indicia-bearing sheet substantially unreadable through said article, said means comprising:

(1) a camouflage pattern on the respective outer surfaces of said base sheet and said cover sheet;

(2) means for obscuring said camouflage pattern; and (3) means for increasing the opacity and reflectivity of said respective outer surfaces of said base sheet and said cover sheet.

38. The article of claim 37 wherein said block out pattern comprises a random printed pattern of jumbled numbers and jumbled letters.

39. The article of claim 37 wherein said means for obscuring said camouflage pattern is a first obscuring coating deposited on said camouflage pattern.

40. The article of claim 39 wherein said first obscuring coating comprises a water-based ink which includes a colored dye or a pigment.

41. The article of claim 37 wherein said means for increasing the opacity and reflectivity of said respective outer surfaces of said base sheet and said cover sheet comprises a second opacifying and reflectivity increasing coating deposited on said first obscuring coating.

42. The article of claim 41 wherein said second opacifying and reflectivity increasing coating comprises a water-based white ink.

43. The article of claim 37 in which said cover sheet and said base sheet are secured at their peripheral edges.

44. The article of claim 37 wherein said cover sheet and said base sheet have perforated removable edge portions.

45. The article of claim 37 wherein said adhesive comprises a hot melt glue.

46. The article of claim 37 wherein said article comprises a mailer construction in which said cover sheet includes a die cut window.

47. The article of claim 46 wherein said die cut window on said cover sheet is covered with a transparent material.

48. The article of claim 47 wherein said transparent material is glassine.

49. A confidential information bearing article comprising a base sheet, a cover sheet overlying said base sheet, and an adhesive securing an inner surface of said cover sheet to an inner surface of said base sheet such that said cover sheet and base sheet are readily separable, said base sheet and said cover sheet having indicia on at least one of their respective inner surfaces, said article including means for rendering said sheets substantially unreadable through said article, said means comprising:

(1) a camouflage pattern on the respective inner surfaces of said base sheet and said cover sheet;

(2) means for obscuring said camouflage pattern; and (3) means for increasing the opacity and reflectivity of said respective inner surfaces of said base sheet and said cover sheet.

50. The article of claim 49 wherein said camouflage pattern comprises a random printed pattern of jumbled numbers and jumbled letters.

51. The article of claim 49 wherein said means for obscuring said camouflage pattern is a first coating of ink deposited on said camouflage pattern.

52. The article of claim 51 wherein said first obscuring coating comprises a water-based ink which includes a colored dye or a pigment.

53. The article of claim 49 wherein said means for increasing opacity and reflectivity of said respective inner surfaces of said base sheet and said cover sheet comprises a second opacifying and reflectivity increasing coating deposited on said first information obscuring coating.

54. The article of claim 53 wherein said second opacifying and reflectivity increasing coating comprises a water-based white ink.

55. The article of claim 49 in which said cover sheet and said base sheet are secured at their peripheral edges.

56. The article of claim 49 wherein said cover sheet and said base sheet have perforated removable edge portions.

57. The article of claim 49 wherein said adhesive comprises a hot melt glue.

58. The article of claim 49 wherein said article comprises a mailer construction in which said cover sheet includes a die cut window.

59. The article of claim 58 wherein said die cut window on said cover sheet is covered with a transparent material.

* * * * *